US008168286B2

(12) United States Patent
James

(10) Patent No.: US 8,168,286 B2
(45) Date of Patent: May 1, 2012

(54) TEMPERED GLASS CHAIR MAT AND METHOD OF PACKAGING

(75) Inventor: Kenneth B James, San Clemente, CA (US)

(73) Assignee: KBJ Enterprises, LLC., San Clemente, CA (US)

( * ) Notice: Subject to any disclaimer, the term of this patent is extended or adjusted under 35 U.S.C. 154(b) by 434 days.

(21) Appl. No.: 12/335,504

(22) Filed: Dec. 15, 2008

(65) Prior Publication Data

US 2009/0155531 A1 Jun. 18, 2009

Related U.S. Application Data

(60) Provisional application No. 61/013,581, filed on Dec. 13, 2007.

(51) Int. Cl.

| | |
|---|---|
| ***B32B 3/02*** | (2006.01) |
| ***E04F 11/16*** | (2006.01) |
| ***E04F 15/08*** | (2006.01) |

(52) U.S. Cl. ..... 428/157; 428/130; 428/192; 428/426; 52/177; 5/417

(58) Field of Classification Search ..... 428/130, 428/157, 192, 426; 52/177; 5/417, 418
See application file for complete search history.

(56) References Cited

U.S. PATENT DOCUMENTS

| | | | | |
|---|---|---|---|---|
| 2,114,473 | A * | 4/1938 | Labra | 428/435 |
| 5,922,419 | A * | 7/1999 | Curran | 428/13 |
| 7,029,743 | B2 * | 4/2006 | Robbins, III | 428/120 |
| 2003/0082347 | A1 * | 5/2003 | Nakai | 428/192 |

* cited by examiner

*Primary Examiner* — Donald J Loney
(74) *Attorney, Agent, or Firm* — Fountain Law Group, Inc.; Vy H. Vu; George L. Fountain

(57) ABSTRACT

A glass chair mat and method of packaging comprising a sheet of tempered glass with rounded corners and rounded beveled edges. The tempered glass chair mat may be finished to enhance its appearance or left translucent to showcase the flooring underneath. The method of packaging allows a minimal amount of employees to safely package the glass chair mat for delivery to residence and businesses alike. Furthermore, the packaging provides additional protection against damage during transit and assures common carriers are aware of the fragile nature of the package.

6 Claims, 4 Drawing Sheets

TEMPERED GLASS CHAIR MAT AND METHOD OF PACKAGING

CROSS REFERENCE TO A RELATED APPLICATION

This application claims the benefit of Provisional Application, Ser. No. 60/013,581, filed on Dec. 13, 2007, which is herein incorporated by reference.

FIELD OF THE INVENTION

This invention relates generally to office furniture, and in particular, to glass chair mats and method of packaging said glass chair mats for shipment.

BACKGROUND OF THE INVENTION

Chair mats are floor coverings made of a relatively thin but durable material. They are placed under office furniture to protect the carpet or flooring underneath the chair mat from scratches, gouges, and dents caused by furniture legs. Besides protecting flooring, chair mats also provide a smoother surface to roll across. Chair mats are possibly best used in conjunction with chairs equipped with casters. Casters or more traditional wheels tend to snag on carpet thus requiring more force to move around. During a typical workday, an office worker may change position dozens possibly hundreds of times. Even relatively little exertion multiplied over a hundred times may cause unnecessary fatigue and reduce productivity. Chair mats provide a stable surface on carpet for a caster equipped chair to roll with minimal force from the occupant.

Typically, chair mats are vinyl or plastic sheets cut in a rectangle and sized according to the area behind a desk. The vinyl or plastic is generally flexible and may possess cleats on the underside to prevent sliding if placed on carpet. One of the problems with vinyl and plastic mats is wear and tear. Plastic and vinyl mats age with time and use. Edges chip, corners fray, and the plastic yellows or clouds with exposure to sunlight. Heavy usage also adds to the toll. Scratches mar the surface leading to an unsightly worn appearance within a few short months.

Oftentimes, dents may occur in areas most often used. For example, at most desks and workstations, an office worker may spend the majority of their time in front of the computer monitor. This position has a "sweet spot" which corresponds to the ergonomic keyboarding position of the typist. The majority of the office worker's time will be spent in this one position and the majority of the office worker's weight will rest on four relatively small areas on the chair mat. Dents will eventually form at these four areas. The dents will naturally trap the casters and prevent them from rolling to other areas, thus increasing the time spent in one area. Eventually cracks will occur at the dents necessitating replacement of the chair mat.

Packaging and shipping glassware also poses potential problems. Due to restrictions on delivery to residential areas, ground is preferred over freight as a method of customer delivery. Ground delivery however is limited by a length and girth measurement thus packaging that is less bulky is desirable.

SUMMARY OF THE INVENTION

An aspect of the invention relates to a chair mat made of tempered glass. The tempered glass chair mat protects carpets and flooring from scratches and gouges. Office chairs equipped with casters provide increased mobility around a desk or workspace. When combined with a tempered glass chair mat, mobility is nearly effortless due to the nearly frictionless nature of the tempered glass mat. As a result, office workers may experience less back strain and arm and leg fatigue when using the tempered glass chair mat.

In one exemplary embodiment, the tempered glass chair mat is made of a single piece of tempered glass with rounded beveled edges. The tempered glass is heat treated to strengthen the glass and make it resistant to impact. Treated or tempered glass also shatters into small cubic pieces. The cubic pieces are easier to dispose of and safer to handle, desirable qualities when employed in a busy office setting.

The beveled edges allow an office worker to roll on and off the chair mat with minimal strain. By rounding the beveled edge sufficient thickness is maintained to withstand the weight of an average adult. A sharp beveled edge has a thinner area of glass at the very edge and is thus more prone to cracks and chips at the outer edge.

Another aspect of the invention relates to a method of efficiently packaging the tempered glass chair mat for shipping by common carrier. The method of packaging involves framing the tempered glass with foam and cardboard and wrapping the package in stretch wrap for further protection. Using clamps and other supporting structures, as detailed later, one employee may safely package the tempered glass chair mat for delivery by common carrier.

DETAILED DESCRIPTION OF THE EXEMPLARY EMBODIMENTS

Figure 1:
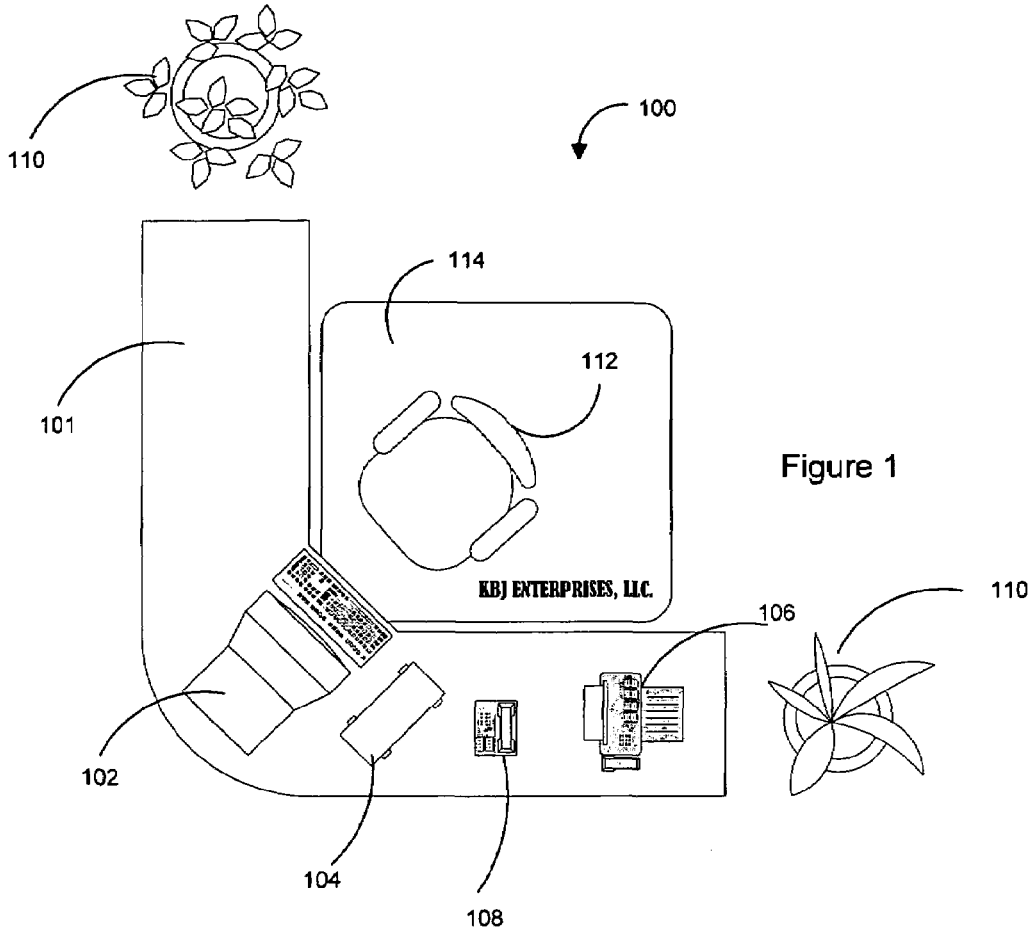
FIG. 1 depicts a typical office with an L shaped desk and an exemplary tempered glass chair mat.

In FIG. 1, a typical office is illustrated. The office depicted includes an L shaped desk 100, a monitor 102, a computer 104, a fax machine 106, telephone 108, plants 110, a swivel chair 112 and a tempered glass chair mat 114.

Tempered glass chair mat 114 may be a sheet of tempered glass, smooth on both sides and rounded at the corners. The tempered glass chair mat 114 may be a uniform thickness between ⅛" to 1" and of custom length and width. Prior to tempering, glass may be altered to enhance appeal and aesthetics. For example, while the glass is molten various metal oxides, sulfides, and other compounds may be added to color or stain the glass. Before the glass chair mat is tempered, the glass may be frosted to create an opaque appearance, or etched with designs or texture. Once tempered, the glass chair mat 114 resists alteration thus coloring, cutting, etching, polishing, etc should be finished before tempering. Alternatively, the tempered glass chair mat may be left transparent to showcase the carpet underneath.

An office worker sitting in swivel chair 112 may find it useful to be able to move freely about the L shaped desk 100 in order to use the various electronics 102-108 situated atop the L shaped desk 100. To this end, swivel chair 112 may be equipped with casters or small wheels affixed to the chair legs. Casters allow the swivel chair 112 to roll across relatively level surfaces.

Because they are generally small and made of plastic, casters are not suited for plush carpets or wood or stone flooring. Casters tend to catch on plush carpeting and require extra effort from the chair's occupant to move even short distances. On polished surfaces such as hardwood floors, marble, or travertine, casters tend to scratch and generally mar the polish again making them unsuitable for use without a chair mat.

To aid the productivity of the office worker, a tempered chair mat 114 may be placed in an area behind the L shaped desk 100. The tempered chair mat 114 may be custom fitted in various sizes and shapes but generally would be more useful if it covers at least the space most travelled by the swivel chair 112 during the course of a typical day. For example, if the office worker generally spends the most time in front of the monitor 102 and telephone 108, then the tempered glass chair mat should be sufficiently large to allow movement between the monitor 102 and telephone 108.

Although swivel chair 112 should ideally stay on top of the tempered glass chair mat 114 at all times, there will be occasions when the office worker accidently rolls off the tempered chair mat 114. Typical chair mats have rounded edges or straight cut edges that hinder attempts to roll back onto the char mat. Once off the chair mat, an office worker may find it necessary to stand up, pick their chair off the ground and place it back onto the typical chair mat. Attempts to force a caster over the rounded edge or straight cut edge while still occupying the chair may lead to the chair tipping over and an embarrassing if not injurious event.

Tempered glass chair mat 114 may also be personalized. For example, in FIG. 1, an exemplary company name "KBJ ENTERPRISES, LLC." is imprinted on the underside of the tempered glass chair mat 114. One method of creating a personalized tempered glass chair mat 114 is to apply a vinyl print of the logo or company name onto the underside of the tempered glass chair mat. Because the lettering is viewed from top down through the transparent chair mat, the adhesive side of the logo or lettering should be facing up. Other options for personalizing a tempered glass chair mat 114 may include laser etching of names, logos, or designs into the glass prior to tempering.

Figure 2:
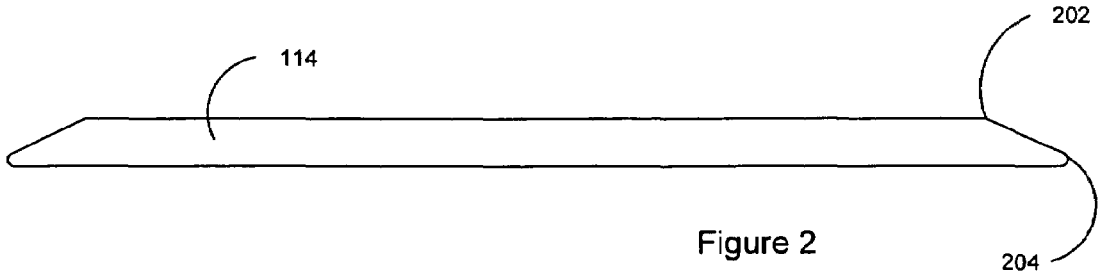
FIG. 2 illustrates a side view of an exemplary tempered glass chair mat showing the beveled edge.

FIG. 2 is an illustration of one embodiment of the tempered glass chair mat 114 as seen from a side view. The illustration is not proportioned to scale and is for the purpose of illustrating the unique beveled edge 202 of an embodiment of the invention.

Tempered glass chair mat 114 may include beveled edges to facilitate remounting the tempered chair mat 114. The beveled edges 202 may be gently sloped and end in a rounded edge 204 at the distal tip. The rounded edge 204 may provide added structural integrity. By rounding the beveled edge, the thin and relatively weak sharp edge is removed. Tempered glass is durable and break resistant but a sharp bevel may be too weak to support the weight of large adults. Furthermore a sharp beveled edge may be hazardous during installation and cleaning.

Shipping glass products, even tempered glass products, are a cause of concern for both vendor and customer. Vendors generally pay an insurance fee to the carrier for extra careful handling. This cost is passed though to the customer either directly or indirectly in the price of the glassware. Carriers also restrict the dimensions of packages not shipped freight. Currently common carriers such as UPS, FEDEX and the U.S. postal service restrict the packages to 165 inches in total length and girth.

Figure 3A:
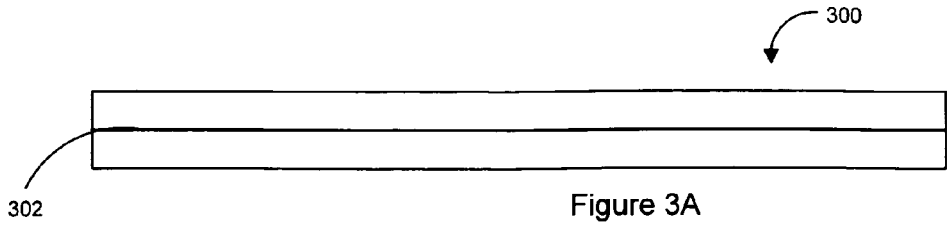
FIG. 3A illustrates an exemplary foam shipping frame.

The method of packaging the tempered glass chair mat 114 for shipment addresses some of these concerns. FIG. 3A illustrates a rectangular bar of foam with a groove cut lengthwise along the entire length creating a foam shipping frame 300. The groove 302 in the foam shipping frame 300 is sufficiently deep to socket an edge of the tempered glass chair mat 114, but is not so deep as to weaken the foam shipping frame 300. In one embodiment, the groove 302 is between ½" to 1" deep and ⅛" to ¼" wide. The foam shipping frame 300 may be cut to suitable lengths to fit the dimensions of a custom sized tempered glass chair mat 114.

Figure 3B:
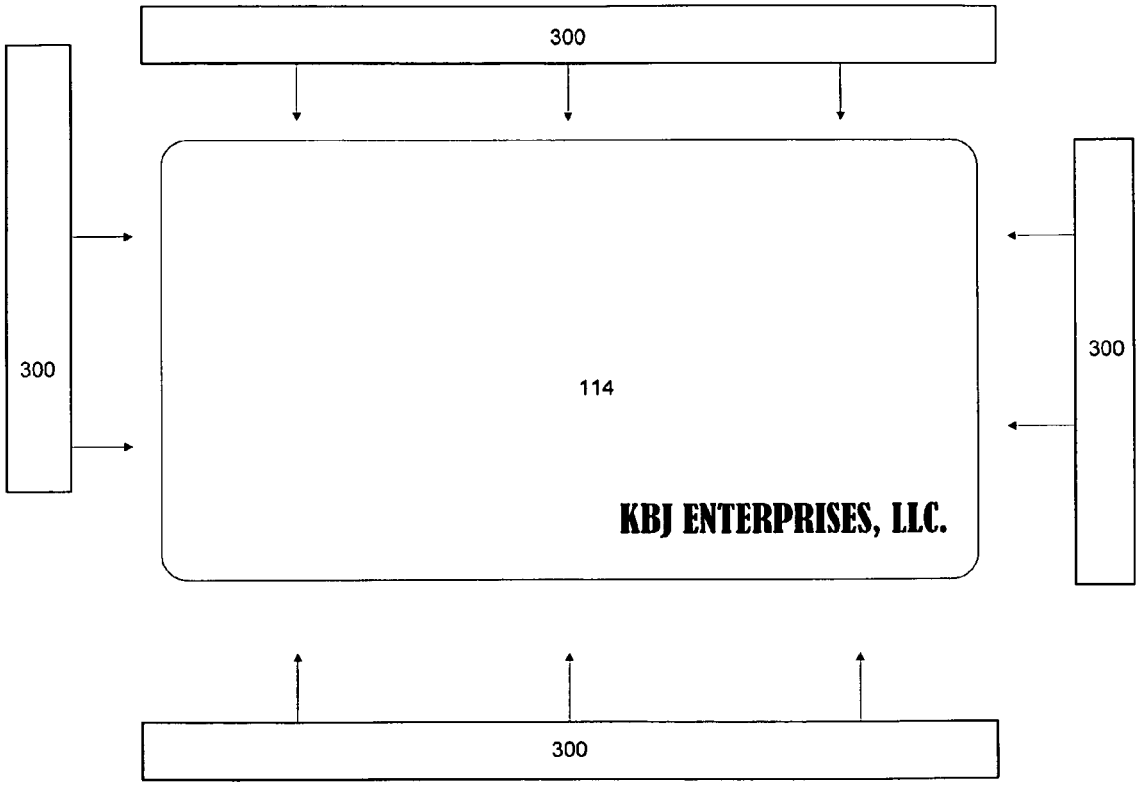
FIG. 3B illustrates an exemplary tempered glass chair mat with exemplary foam shipping frame.

FIG. 3B illustrates the foam shipping frame 300 positioned to engage the edges of the tempered floor mat 114. In this embodiment the foam shipping frames 300 are cut slightly longer than the length of the tempered glass chair mat 114. The foam shipping frame 300 attached to the width of the tempered glass chair mat 114 are cut shorter than the width of the tempered glass chair mat 114. When attached to the edges of the tempered glass chair mat 114, the foam shipping frames 300 will overlap and form a substantially 90 degree corner. It is understood that the foam shipping frame attached to the width may be cut longer and the length cut shorter with the same end result. Alternatively the corners may be mitered to form a substantially 90 degree corner.

Figure 4A:
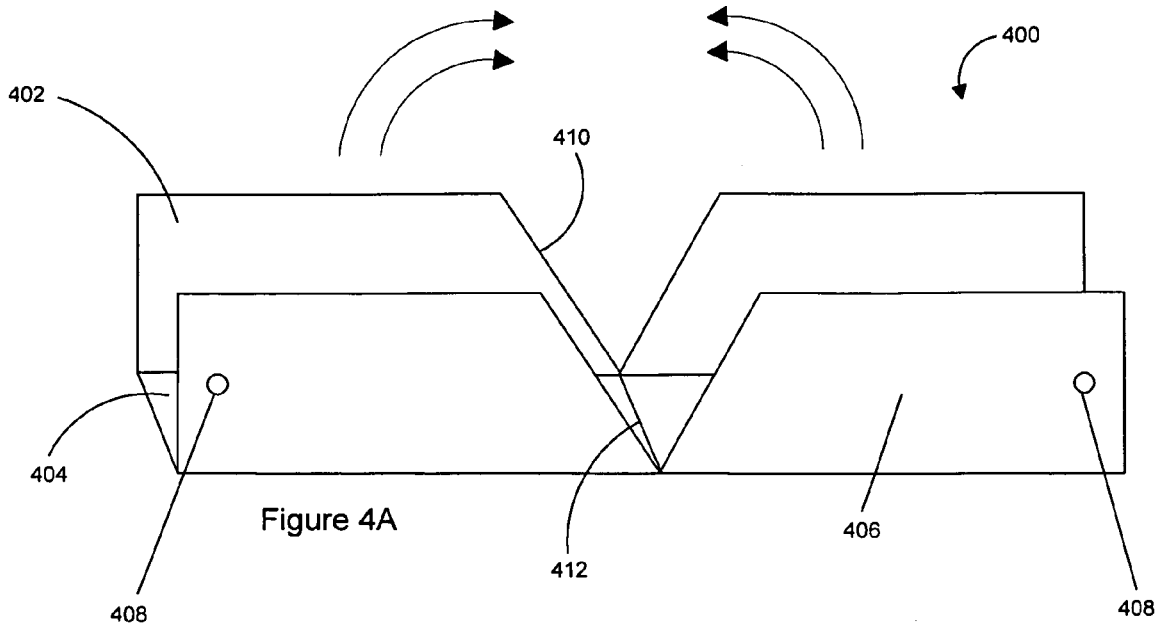
FIG. 4A illustrates an exemplary folding reinforcing corner in the open position.
Figure 4B:
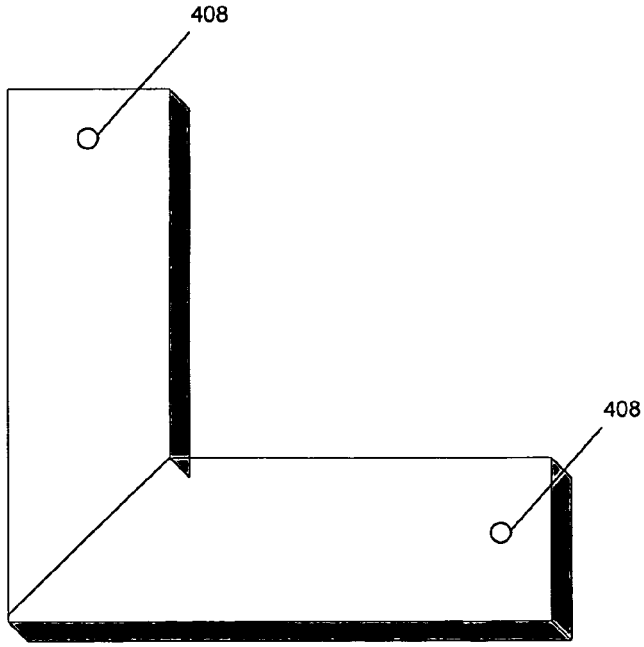
FIG. 4B illustrates an exemplary reinforcing corner in the closed position.

Once the foam shipping frames 300 are attached, reinforcing corners are placed over the corners of the foam shipping frame 300. FIGS. 4A and 4B illustrate one embodiment of the reinforcing corners 400. Each reinforcing corner 400 may be constructed of a durable but economical material. In one embodiment, the reinforcing corners are made of thick recycled cardboard. Other embodiments may include plastic, vinyl, light wood etc. Reinforcing corner 400 comprise a back flap 402, a base 404, front flap 406, pin hole 408, v-cut 410 and score line 412.

During manufacture and shipping, back flap 402 and front flap 406 are flattened and lie in the same plane as base 404. This configuration allow for easier manufacture as well as tighter and more economical packaging. When flat, reinforcing corner 400 takes up very little room and may be stacked for transport. During assembly, back flap 402 and front flap 406 are folded along pre-scored lines into an upright position substantially perpendicular to the plane of base 404. Next, the left and right "wings" are folded along score line 412 effectively closing v-cut 410. The resulting closed configuration resembles a hollow L-shape with pin holes 408 at the distal ends and centered between the three edges at the ends of the L.

Figure 5:
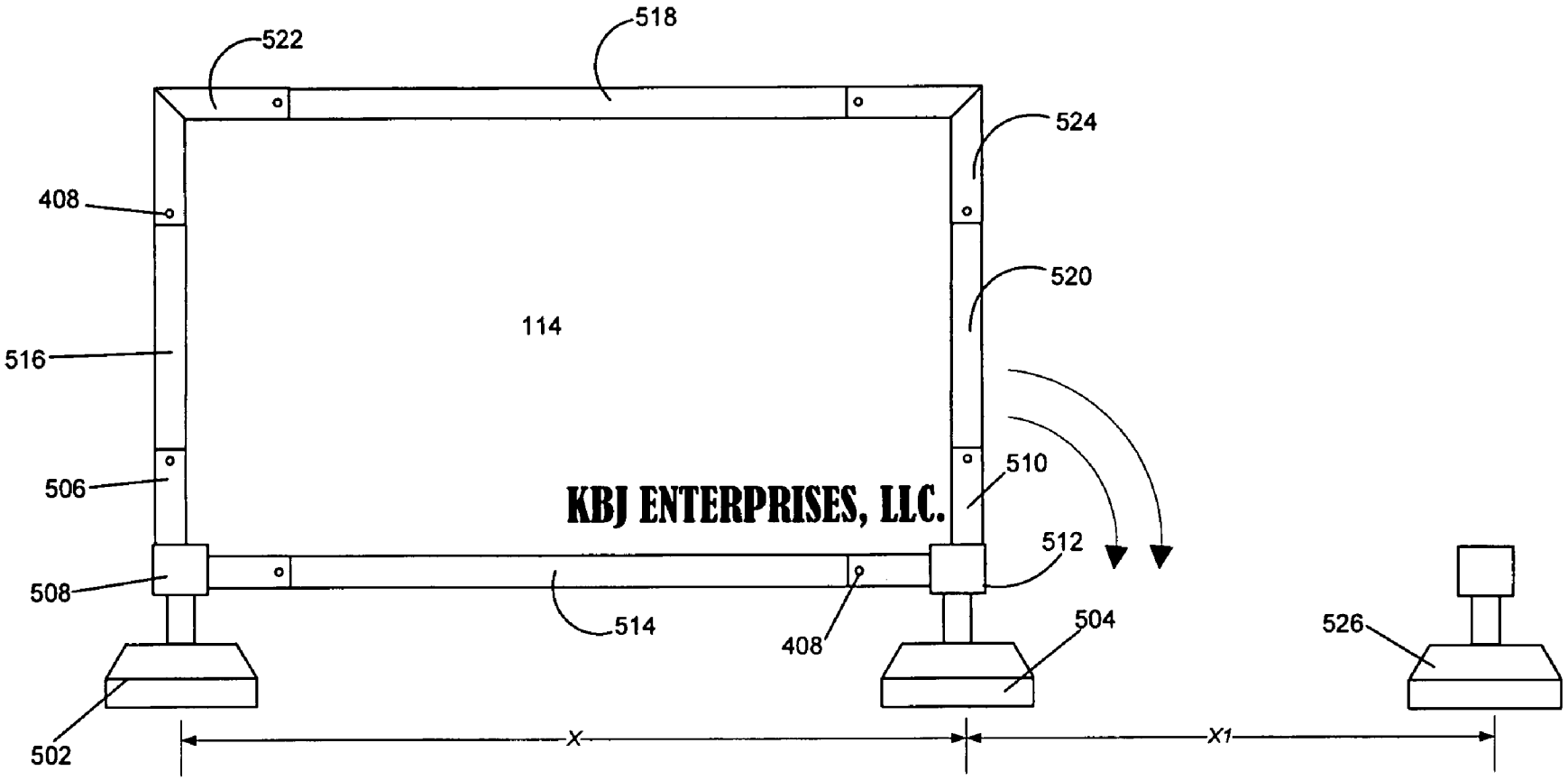
FIG. 5 illustrates an exemplary method of packaging a glass product for shipping.

FIG. 5 illustrates a method of packaging the invention in accordance with the principles of the invention. The method of packaging embodied in this invention allows the shipment of tempered glass chair mats 114 with minimal use of employees and very little capital equipment. A first base 502 is placed on a flat level surface. A second base 504 is placed at a distance from the first base 502 approximately equal to the length of the tempered glass chair mat to be shipped. For example the length x between the $1^{st}$ and $2^{nd}$ base 502 and 504 respectively is approximately equal to the length of the tempered glass chair mat 114. A first reinforcing corner 506 is secured by first clamp 508. A second reinforcing corner 510 is secured to a second clamp 512. A first foam shipping frame 514 is placed between reinforcing corners 506 and 510 with groove 302 facing upwards. A tempered glass mat 114 is carefully placed within groove 302 and partially supported by first and second clamps 508 and 512 and reinforcing corners 506 and 510. Second, third and fourth (516, 518, 520) foam shipping frames are attached to the edges of tempered glass chair mat 114 with the ends mated to form substantially 90 degree corners. Third and fourth reinforcing corners 522 and 524 are added to the upper corners. Pins are pushed through pin holes 408 of the reinforcing corners into the foam shipping frames. Once all reinforcing corners are attached and secured, stretch wrap is rolled over the package.

By using a third base 526 only one employee may be needed to package a tempered glass chair mat 114. Placing a third base 526 at distance $x^1$ from the second base 504 allows the partially wrapped package to be rotated clockwise and supported on second and third bases 504 and 526. The distance $x^1$ roughly corresponds to the width of the package. Once upright, additional stretch wrap may be applied to the package. A fourth base (not shown) placed at a distance approximately equal to the length of the package from the third base 526 allows another rotation and subsequent stretch wrapping of the unwrapped sections of the packaging.

The method of packaging described conforms to the 165" standard for ground shipment. Ground shipment may be advantageous for monetary reasons. Plus, freight shipments do not deliver to residential locations thus reducing the client base. Another advantage of the method of packaging is the end package is transparently wrapped thus making carriers actively aware of the fragile nature of the contents. Presumably, the extra care will reduce damage in transit and cost of replacing a damaged tempered glass chair mat 114.

The tempered glass chair mat 114 may utilize recyclable glass. Additionally, glass is not petroleum based and thus is less damaging to the environment. Recycled cardboard may be used to form the reinforcing corners 400 further lessening the impact to the environment. While the invention as described utilizes renewable resources, it is understood that less eco-friendly materials may be substituted without diverging from the core concept of the invention.

By utilizing the method of packaging previously described, fewer employees are required to safely handle the packaging and shipping of the product. A single employee may be capable of packaging several dozen tempered glass chair mats 114 per day.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A glass chair mat comprising:

a substantially planar sheet of glass of uniform thickness between ⅛ inch to 1 inch;

the substantially planar sheet of glass, further comprising;

one or more rounded corners; and one or more beveled edges wherein, the area of the chair mat is selected to cover the area behind a desk, with the area of the chair mat being at least greater than the area between the four legs of an office chair, such that all four legs of the office chair can rest upon the chair mat at the same time.

2. The glass chair mat of claim 1, further comprising a logo, company name, or design applied to the underside of the glass chair mat.

3. The glass chair mat of claim 1, further comprising a logo, company name, or design laser etched into the glass.

4. The glass chair mat of claim 1, wherein the sheet of glass is tempered glass.

5. The glass chair mat of claim 1, wherein the beveled edges are rounded.

6. The glass chair mat of claim 1, wherein the sheet of glass is colored, tinted, frosted, or textured.

* * * * *